United States Patent [19]

Cavallari

[11] Patent Number: 4,662,764

[45] Date of Patent: May 5, 1987

[54] RUBY AND NEEDLE GUIDING GROUP FOR NEEDLE PRINTING HEAD

[75] Inventor: Piergiuseppe Cavallari, Novara, Italy

[73] Assignee: Honeywell Information Systems Italia, Milan, Italy

[21] Appl. No.: 777,133

[22] Filed: Sep. 18, 1985

[30] Foreign Application Priority Data

Oct. 5, 1984 [IT] Italy ..... 23008 A/84

[51] Int. Cl.[4] ..... B41J 3/12

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 3,802,543 | 4/1974 | Howard | 400/124 |
| 3,833,105 | 9/1974 | Howard | 400/124 |
| 3,927,751 | 12/1975 | Juret | 400/124 |
| 3,991,870 | 11/1976 | McIntosh | 400/124 |
| 3,991,871 | 11/1976 | McIntosh, Sr. | 400/124 |
| 4,046,303 | 9/1977 | Reier et al. | 400/124 |
| 4,180,333 | 12/1979 | Linder | 400/124 |
| 4,365,902 | 12/1982 | Biedermann | 400/124 |
| 4,470,713 | 9/1984 | Rossopoulos | 400/124 |
| 4,501,506 | 2/1985 | Weeks et al. | 400/124 |

FOREIGN PATENT DOCUMENTS

| | | | |
|---|---|---|---|
| 55-142671 | 11/1980 | Japan | 400/124 |
| 56-148572 | 11/1981 | Japan | 400/124 |
| 1332142 | 10/1973 | United Kingdom | 400/124 |

*Primary Examiner*—Edgar S. Burr
*Assistant Examiner*—David A. Wiecking
*Attorney, Agent, or Firm*—Nicholas Prasinos; John S. Solakian

[57] ABSTRACT

A needle end ruby of a needle printing head where the printing needle writing ends are arranged along one or more parallel columns is comprised of two or more plates juxtaposed on one or more planes. Each plate is rigidly fixed to the contiguous plate or plates. The ruby guiding openings for one column of the needle writing ends are obtained by shaping and grinding the sides along which two plates are juxtaposed and fixed.

At least one of the plates comprising the ruby has a different height in relation to the remaining juxtaposed plate(s). Thus the ruby presents two ground surfaces used for accurately positioning the ruby into a housing in the nose end of a guiding needle head.

Alternately the guiding ruby, though comprised of plates of equal height, can still present two reference ground surfaces by juxtaposing and fixing at least two of the plates in a staggered manner so as to expose precisely ground surfaces utilized to accurately position the ruby into its housing.

6 Claims, 11 Drawing Figures

FIG. 1
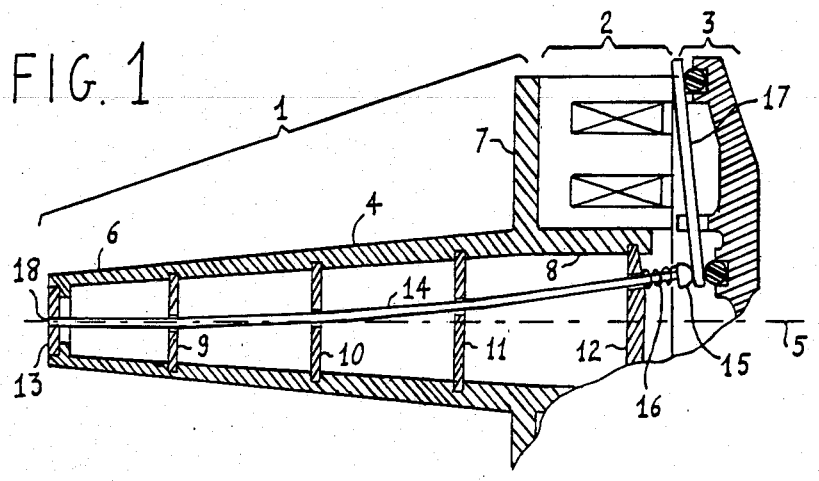
FIG. 2A
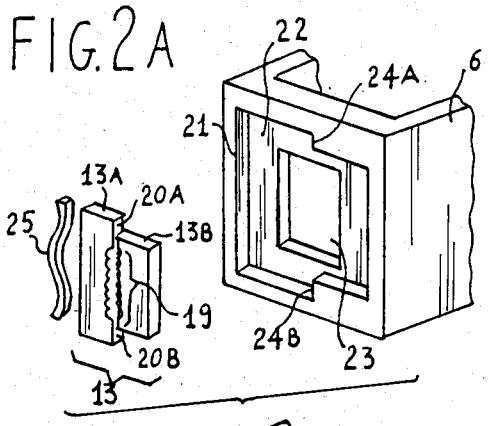
FIG. 2B
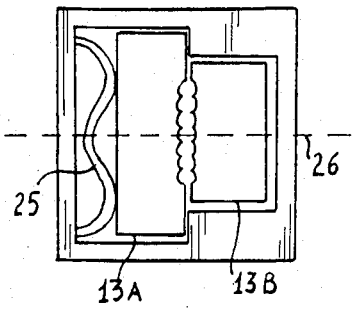
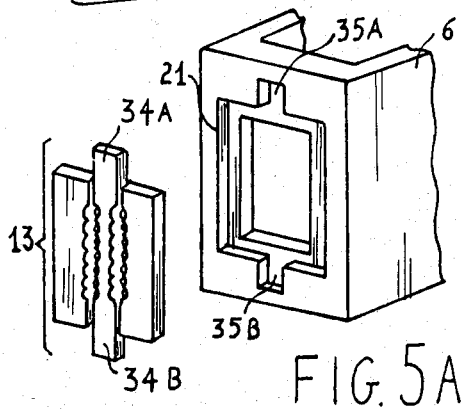
FIG. 5A
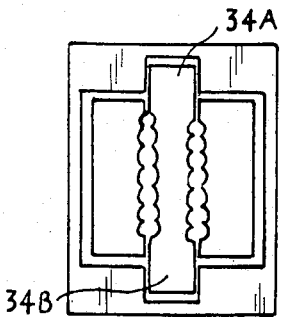
FIG. 5B

RUBY AND NEEDLE GUIDING GROUP FOR NEEDLE PRINTING HEAD

BACKGROUND OF THE INVENTION

1. Field of the Invention

The present invention pertains to a ruby and a needle guiding group for a needle printing head, and more particularly to the guiding end structure of such a group.

2. Description of the Prior Art

The needle printing heads are generally comprised of a printing needle guiding group, an electromagnetic group for the actuation of the several needles and an armature retaining group of the printing electromagnets. Typical structures of printing heads are disclosed by several patents; e.g., U.S. Pat. Nos. 4,140,406 and 4,260,270. The printing needle guiding group is generally comprised of an elongated, conical or pyramid shaped nose internally provided with suitable guides able to gradually bend the needles in a direction which is transverse to the longitudinal axis of the cone or pyramid. This bending also shifts the initial circular distribution to an end distribution in parallel columns. In order to generate characters along a printing line sequentially, the head is mounted on a carriage which slides parallel to a platen which supports the printing surface. The characters are then generated by actuating the needles in a selective manner. The needle guides are comprised of pierced diaphragms spaced along the guiding nose axis and are arranged perpendicularly to said longitudinal axis. This is shown in the above-mentioned U.S. patents.

In another embodiment the needle guides are comprised of one or more continuous guiding elements of the type disclosed in U.S. Pat. No. 4,081,067 and by British Pat. No. 1,450,346 which corresponds to U.S. Pat. No. 3,897,865. The guiding ruby of the printing needle writing ends is comprised of two or three alumina plates depending on whether such ends are arranged on one or two parallel columns respectively. Alumina plates, generally rectangularly shaped and having a thickness of about 1 mm are typically joined and fastened by means of epoxy glue in order to form a single rectangular shaped plate. The openings for guiding the needle ends are positioned along the contact line of two contiguous plates. The openings for the needle ends are formed during the preparation of the guiding ruby, by suitably shaping the side of the plate which will be contiguous to the side of a contiguous plate. A grinding operation of the shaped sides follows and then the positioning and the glueing of the plates on these sides is done. Generally, the grinding of the remaining sides of the plates comprising the guiding ruby is not performed so as to avoid a large increase in the cost of the ruby since the cost of the ruby is determined primarily by the machining operations and not the cost of the raw material. Once ready, the ruby is inserted into a housing on the top of the guiding nose and attached therein by means of epoxy glue. This last operation takes a long time and is particularly difficult. It significantly affects the assembling time and therefore the printing head cost. In fact the axis along which the line or the lines of ruby guiding openings are positioned must be perpendicular to the printing plane of the head on the carriage, and consequently to the printing line. This is necessary to avoid both degradation of the printing quality caused by a slope of the printing characters and the stressing of the printing needles which causes their printing ends to bend. The ruby is inserted into the guiding nose housing and suitably fixed to a reference plane, and locked in the correct relative position by means of a pin tool until the epoxy glue is completely cured. This long and expensive operation is required because the nose guiding of the housing must allow the housing of rubies each of which has different characteristics with large tolerances. Therefore, a considerable clearance generally exists between housing and ruby, which prevents the use of the housing as a means of positioning the ruby correctly.

OBJECTS OF THE INVENTION

It is a main object of the invention to provide an improved needle guiding ruby.

It is another object of the invention to provide apparatus and a method for correctly positioning and fixing a needle guiding ruby in the guiding nose housing in a simple manner.

SUMMARY OF THE INVENTION

The present invention allows the correct positioning and fixing of the ruby into the guiding nose housing in a very simple and fast manner without the need of special tools. According to the present invention this is obtained by taking care that at least one of the plates comprising the guiding ruby has a height different from one of the remaining plates; or, that two contiguous plates at least are fixed relative to each other by being staggered to expose their ground sides. Accordingly once prepared, the ruby presents at least two ground surfaces which may be used to correctly position the ruby into the housing on the top of the guiding nose during its insertion therein. To do this, the housing is provided with some reference surfaces against which the sides of the ruby that have been ground can lay. The firm contact between reference surfaces and ground surfaces during the attachment phase (by epoxy glue) of the ruby into the guiding nose housing, is provided by resilient elements which suitably press against the ruby when it is inserted into the guiding nose housing.

According to a further embodiment of the invention such resilient pressing elements are not required where the printing needle writing ends are arranged in two or more parallel columns.

BRIEF DESCRIPTION OF THE DRAWINGS

These and other characteristics will appear more clearly from the following description of some preferred embodiments of the ruby and of the needle guiding group of the present invention and from the enclosed drawings where:

FIG. 1 partially shows a sectional view of a needle printing head.

FIGS. 2A, 2B respectively show an exploded perspective view and a front elevation view, of an embodiment according to the present invention, of the ruby and of the end of the needle guiding group and the printing head of FIG. 1 when the needle writing ends are arranged in one column.

FIGS. 5A, 5B respectively show an exploded perspective view and a front elevation view, of an embodiment according to the present invention, of the ruby and of the nose of the needle guiding group of the printing head of FIG. 1 where the writing needle ends are arranged according to two parallel columns.

DESCRIPTION OF THE PREFERRED EMBODIMENT

Figure 3A:
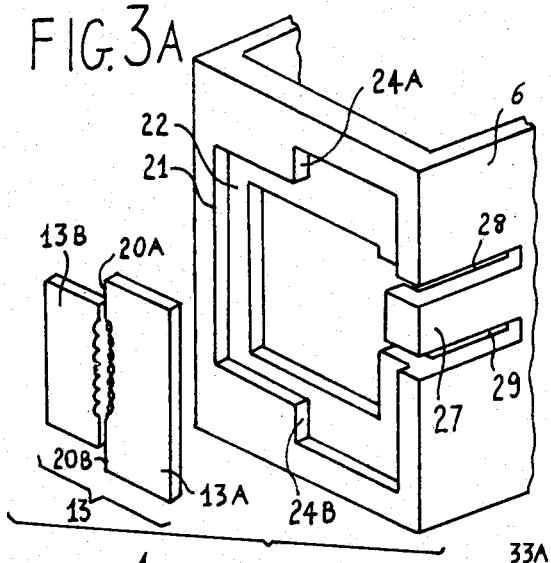
FIGS. 3A, 3B respectively show an exploded perspective view and a front elevation view of a variant of the invention of the nose of the needle guiding group of FIGS. 2A, 2B.

The printing head of FIG. 1 comprises a needle guiding group 1, an electromagnet group 2 and an armature retainer group 3. Needle guiding group 1 comprises a nose or body 4 elongated in the direction of a longitudinal axis 5. The body 4 has a generic C-shaped section tapered toward end 6, a flange 7 arranged at the base of nose 4 and extending transverse to axis 5, and a cylindric or prismatic shaped bush 8 extending at the opposite side of the flange from the nose 4. The needle guiding group can be suitably obtained by casting or molding. Nost 4 and bushing 8 are internally arranged with needle guiding diaphragms 9, 10, 11, 12 spaced along axis 5 and arranged perpendicularly to it. Each diaphragm is provided with a number of openings equal to the number of needles to be guided. The openings are circularly arranged around axis 5 in diaphragm 12. The arrangement of openings become more elliptical in diaphragms 11, 10, 9, as they approach the top of the nose 4. The nose top has a prismatic shaped housing where a needle guiding ruby 13 is set. The ruby is provided with a number of housings equal to the number of needles that are arranged on one or two lines, or may be provided with one or two contiguous needle guiding grooves. A predetermined number of needles, generally variable from 7 to 24 depending on the type of printing head, is inserted into the openings of the diaphragms and of the ruby. FIG. 1 shows, for simplicity's sake, only one needle 14 inserted into its housing and provided with a printing head 15. Between diaphragm 12 and head 15, a coil spring 16 is inserted on needle 14 which provides a bias away from diaphragm 12. The head 15 of needle 14 lays against an armature 17 which is kept in a rest position by armature retaining group 3. When needle 14 is in rest position, its writing point 18 is coplanar with the outside surface of guiding ruby 13. Electromagnet group 2 and armature retainer group 3 are of conventional types as typically disclosed in the mentioned U.S. Pat. No. 4,260,270.

In another embodiment the electromagnetic group can be comprised of a toroidal body in plastic material where the electromagnetic cores, the related windings and the electric connecting elements are typically encased as disclosed by U.S. Pat. No. 4,433,927.

FIGS. 2A, 2B respectively show, in perspective, an exploded view and a front elevation view of an embodiment of the end portion 6 of needle guiding group 1 and of the guiding ruby in accordance to one embodiment of the present invention, when the writing ends of the printing needles are arranged along only one column. The guiding end ruby 13 is comprised of two contiguous alumina plates 13A, 13B attached to each other by means of epoxy glue. Guiding openings 19 of the printing needles are obtained by suitably shaping and grinding the sides along which plates 13A, 13B are joined. Plate 13A is slightly larger than plate 13B in order to present two free gound surfaces 20A, 20B which define a plane parallel to the axis (not shown) of the guiding openings 19 of ruby 13. Ruby 13 is inserted into a housing 21 on the end portion 6 of group 1 and is locked against a bottom plane 22 which is provided with a window 23 to permit the passage of the printing needles. Housing 21 is suitably shaped like ruby 13 and more particularly, it is provided with two reference ledges 24A, 24B. Free ground surfaces 20A, 20B of the ruby are forced against ledges 24A and 24B respectively when the ruby is inserted into housing 21. A leaf spring 25 provides a bias to hold the ruby assembly in place when inserted in its housing. The plane defined by ledges 24A, 24B is perpendicular to dash line 26 of FIG. 2B showing the direction along which the printing head of FIG. 1 moves during the printing of a row of characters, where each character is comprised of a plurality of dots arranged according to the required character to be printed for each printing position. It should be clear that the axis (not shown) along which openings 19 are arranged is in a correct relative position during the insertion of ruby 13 into housing 21 of guiding nose end 6, and that it maintains such correct position during the attachment of ruby 13 to guiding nose end 6 by means of epoxy glue. Weighed against a very small increase in ruby 13 cost because of the greater size of plate 13A, a significant reduction is obtained in assembly time and operation of the needle guiding group ends. Therefore there results a significant reduction in the printing head cost.

Figure 3B:
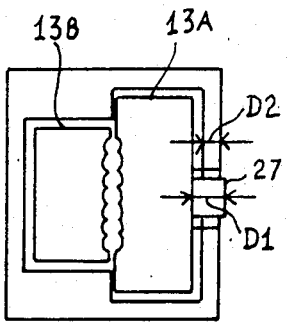

In the embodiment shown in FIGS. 2*a*, 2B the handling of leaf spring 25 may cause some problems because of its small size. In order to avoid such problems. as well as to reduce the number of parts comprising the needle guiding group, FIGS. 3A and 3B respectively show, in perspective, an exploded view and a front elevation view a variant of end 6 of needle guiding group 1. From FIGS. 3A, 3B (where the same reference numerals of FIGS. 2A, 2B are retained for most of the elements) it is seen that leaf spring 25 of FIGS. 2A, 2B has been replaced by a resilient push arm 27. This push arm is formed from one side of the guiding nose by cutting two grooves 28, 29 on the side. The arm 27 acting on the ruby has a width D1 slightly greater than width D2 of the corresponding part defining housing 21 so as to extend inwardly. In this manner the insertion of ruby 13 into housing 21 causes a slight axial bending of arm 27 which elastically tends to return to its neutral position; accordingly it forces the ground surfaces 20a, 20B of ruby 13 against reference surfaces 24A, 24B. Arm 27 can be easily fabricated during the molding of the guiding nose by suitably shaping the mold. It is clear that the ruby pushing element can have several alternate shapes obtainable by suitably shaping guiding nose end 6.

Figure 4A:
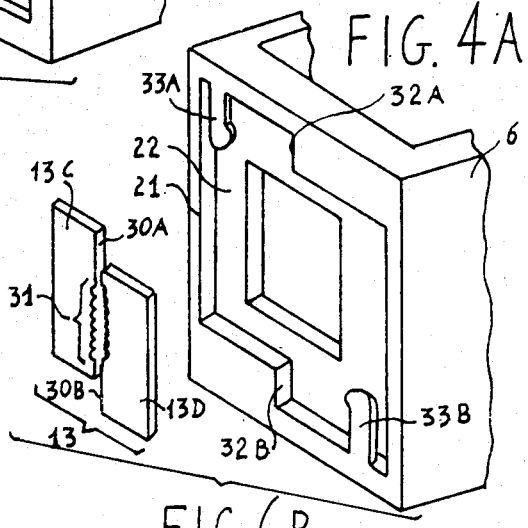
FIGS. 4A, 4B respectively show an exploded perspective view and a front elevation view, of a further embodiment of the present invention, of the ruby and of the nose of the needle guiding group of the printing head of FIG. 1 where the needle writing ends are arranged along one column.
Figure 4B:
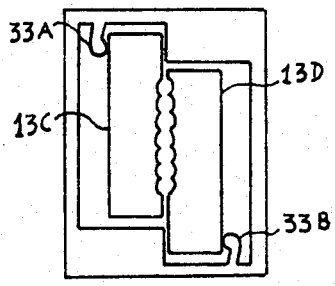

FIGS. 4A, 4B respectively show, in perspective, an exploded view and front elevation view of still another embodiment in accordance to the invention, of ruby 13 and of end 6 of the printing head needle guiding group of FIG. 1 wherein the writing tips of the needles are arranged according to only one column. Ruby 13 is comprised of two alumina plates 13C, 13D having ground sides of equal length. These plates are juxtaposed and held to each other in a staggered manner in order to make two ground surfaces 30A, 30B exposed on the juxtaposition plane. The surfaces are parallel to the axis (not shown) along which the guiding openings 31 of the ruby are arranged. Ruby 13 is inserted into housing 21 which is provided with two reference surfaces 32A, 32B and with two elastic pushing arms 33A, 33B. These arms have a thickness smaller than the depth of housing 21 and therefore they are not restrained by the bottom plane 22. When ruby 13 is inserted into housing 21, arms 33A, 33B are stressed axially and bend; accordingly they tend to elastically return to their original position and force the ground surfaces 30A, 30B of ruby 13 against the reference surfaces 32A, 32B of housing 21. The presence of ruby 13 pushing elements, such as 25 (FIGS. 2A, 2B), 27 (FIGS. 3A, 3B) or 33A, 33B (FIGS. 4A, 4B) is not required when the printing needle ends are arranged along two or more parallel columns. This case is shown on FIGS. 5A and 5B.

Referring now to FIGS. 5A, 5B respectively there is shown, in perspective, an exploded view and a front elevation view of an embodiment according to the invention, where two parallel columns of needles are utilized. In this case the ruby is comprised of two lateral plates rigidly attached to a common central plate by epoxy glue. Note that the common central plate extends beyond the lateral plates forming ground pins 34A and 34B. These ground pins 34a, 34B are intended to be inserted into two corresponding reference housings 35A, 35B of housing 21. It should be clear that in this case the width of housings 35A, 35B must have close tolerances relative to the other dimensions of housing 21 in order to match the width of the pins 34A, 34B. Thus at the time of insertion into housing 21, ruby 13 is set in the correct relative position and maintains this position during the attaching phase by epoxy glue.

Figure 6A:
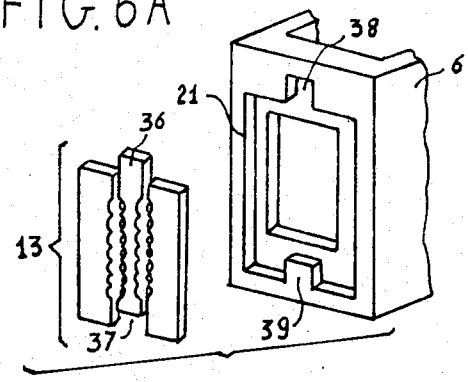
FIGS. 6A, 6B respectively show an exploded perspective view and a front elevation view, of a further embodiment according to the present invention, of the ruby and of the nose of the needle guiding group of FIG. 1 where the needle writing ends are arranged according to two paralel columns.
Figure 6B:
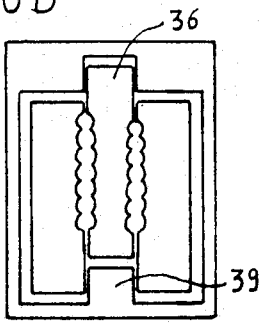

FIGS. 6A, 6B show, in perspective, an exploded view and a front elevation view of a further embodiment according to the present invention, where the needle writing ends are arranged in two parallel columns. Ruby 13 is comprised of alumina plates having the same height. The central plate is juxtaposed to these plates and fixed to the lateral plates in a staggered manner so that ruby 13 presents a pin 36 and a recess 37 both ground laterally. Pin 36 is inserted into a reference housing 38 of housing 21 while recess 37 receives a reference pin 39. Housing 38 and pin 39 are ground to close tolerances in order to match precisely pin 36 and recess 37 of the ruby.

It is therefore clear that several changes may be made to the disclosed embodiments of the ruby of the end of a printing head needle guiding group without departing from the scope of the invention.

What is claimed is:

1. A needle guiding ruby for a needle printing head where needle writing ends are arranged along at least one column, said needle printing head having a housing with reference ledges for housing said ruby, said ruby being comprised of at least two contiguous plates having juxtaposed contact sides, each of the plates being rigidly fixed to at least one other of said plates, said ruby having a column of guiding openings for a column of said writing ends, the openings being obtained by shaping and grinding the juxtaposed contact sides of the two rigidly fixed contiguous plates, characterized in that said contiguous plates have ground juxtaposed contact sides of equal length and are fixed in a staggered position relative to their length.

wherein said fixed contiguous staggered plates present at least two exposed ground surfaces which are parallel to said column of guiding openings, said exposed ground surfaces comprising means for accurately aligning said plates and said openings relative to said housing, by juxtaposition of said exposed ground surfaces and said reference ledges.

2. A needle guiding ruby for a needle printing head where needle writing ends are arranged along at least one column, said needle printing head having a housing with reference ledges for housing said ruby, said ruby being comprised of at least two contiguous plates having juxtaposed contact sides, each of the plates being rigidly fixed to at least one other of said plates, said ruby having a column of guiding openings for a column of said writing ends, the openings being obtained by shaping and grinding of the two rigidly fixed contiguous plates, characterized in that said contiguous plates have ground juxtaposed contact sides of different length and are fixed relative to each other so as to leave two ground surfaces exposed which are parallel to said column of guiding openings, said exposed around surfaces comprising means for accurately aligning said plates with each other and for a accurately aligning said openings relative to said housing by juxtaposition of said exposed ground surfaces and said reference ledges.

3. A needle guiding group for a needle printing head, where needle writing ends are arranged along at least one column comprising:

a guiding ruby comprised of at least two contiguous plates having juxtaposed contact sides, each of the plates being rigidly fixed to at least one other of said plates, said ruby having a column of guiding openings for a column of said writing ends, the openings being obtained by shaping and grinding the juxtaposed contact sides of the two rigidly fixed contiguous plates, said contiguous plates having ground contact sides of equal length, and being fixed in a staggered position relative to their length, wherein said fixed contiguous staggered plates present at least two exposed ground surfaces which are parallel to said column of guiding opening, a housing for said guiding ruby provided with reference ledges and lateral shoulders for restraining said ruby and means for accurately aligning said plates and therefore said openings, relative to said housing, comprising the exposed ground surfaces of said plates and said reference ledges on the housing, said lateral shoulders having resilient means acting on said ruby to push said exposed ground surfaces against said reference ledges.

4. Needle guiding group for a needle printing head, wherein needle writing ends are arranged along at least one column, comprising:

a guiding ruby comprised of at least two contiguous plates having juxtaposed contact sides, each of the plates being rigidly fixed to at least one other of said plates, said ruby having a column of guiding openings for a column of said writing ends, the openings being obtained by shaping and grinding the contact sides of the two rigidly fixed juxtaposed contiguous plates having ground contact sides of different length and being fixed relative to each other so as to leave exposed two ground surfaces which are parallel to said column of guiding openings, a housing for said guiding ruby provided with reference ledges and lateral shoulders for restraining said ruby and means for accurately aligning said plates and therefore said openings, relative to said housing, comprising the exposed ground surfaces of said plates and said reference ledges on the housing, said lateral shoulder having resilient means acting on said ruby to push said exposed ground surfaces against said reference ledges.

5. Needle guiding group for a needle printing head where needle writing ends are arranged along at least two parallel columns, comprising:

a guiding ruby having two parallel columns of openings for guiding said writing ends comprised of three plates, juxtaposed on parallel contact sides and contiguous in pairs, each of the plates being rigidly fixed to at least one other of said plates, the guiding opening of said ruby being positioned by shaping and grinding the parallel contact sides;

further comprising a housing for said guiding ruby provided with lateral shoulders for containing said ruby, said housing being further provided with at least one housing recess and one housing reference pin, said three plates having ground parallel contact sides of equal length and being fixed by staggering said three plates along their length in order that said ruby presents at least one ruby pin and one ruby recess with ground lateral sides which are parallel to said opening columns and means for accurately aligning said three plates and therefore said openings relative to said housing comprising said housing reference pin for insertion in said ruby recess and said ruby pin for insertion in said housing recess.

6. Needle guiding group for a needle printing head where needle writing ends are arranged along at least two parallel columns comprising:

a guiding ruby having two parallel columns of openings for guiding said writing ends comprised of two side plates and an intermediate plate juxtaposed on parallel contact sides and contiguous in pairs, each of the plates being rigidly fixed to at least one other of said plates, the guiding openings of said ruby being positioned by shaping and grinding said parallel contact sides, further comprising a housing for said guiding ruby, provided with lateral shoulders for containing said guiding ruby, said housing being further provided with two recesses, said intermediate plate having ground parallel contact sides of greater length than the one of the ground parallel contact sides of said two side plates, and being fixed to the side plates so that said guiding ruby has two ruby pins with ground lateral sides parallel to the guiding opening columns and means for accurately aligning said plates and therefore said openings relative to said housing comprising said two ruby pins each for insertion in one of said two recesses of said housing.

* * * * *